US005657869A

United States Patent [19]

Carroll, III

[11] Patent Number: 5,657,869

[45] Date of Patent: Aug. 19, 1997

[54] PROMOTIONAL PACKAGING ASSEMBLY FOR LABELS

[76] Inventor: Leo P. Carroll, III, 9 Lakeview Dr., Shelburne, Vt. 05482

[21] Appl. No.: 461,707

[22] Filed: Jun. 5, 1995

[51] Int. Cl.[6] ..... B65D 73/00; B65D 85/00; B42D 15/00

[52] U.S. Cl. ..... 206/451; 206/447; 206/459.5; 229/92.8; 283/81; 283/116

[58] Field of Search ..... 206/447, 449, 206/450, 451, 459.5, 460, 232; 283/81, 101, 116; 462/900, 901, 64, 65, 18; 229/92.8, 70

[56] References Cited

U.S. PATENT DOCUMENTS

| | | | |
|---|---|---|---|
| 541,833 | 7/1895 | Brinckle | 206/451 X |
| 619,054 | 2/1899 | Strauss et al. . | |
| 856,689 | 6/1907 | Fehrenback | 283/81 X |
| 901,357 | 10/1908 | Lewis | 206/449 X |
| 1,564,152 | 12/1925 | Thomson | 206/472 |
| 1,577,043 | 3/1926 | Mackey | 229/92.8 |
| 1,885,076 | 10/1932 | Bustamante | 206/451 X |
| 2,213,666 | 9/1940 | Burke | 283/81 |
| 3,123,384 | 3/1964 | Baker | 462/901 X |
| 3,266,714 | 8/1966 | Herberger | 229/92.8 |
| 3,368,791 | 2/1968 | Mercur | 229/70 |
| 4,204,706 | 5/1980 | Blum et al. . | |
| 4,278,199 | 7/1981 | Tanaka | 229/92.8 |
| 4,351,474 | 9/1982 | Kaelber et al. | 462/64 X |
| 4,627,994 | 12/1986 | Welsch . | |
| 4,872,706 | 10/1989 | Brewen et al. . | |
| 4,890,862 | 1/1990 | Buchholz . | |
| 4,973,088 | 11/1990 | Levy . | |
| 5,022,526 | 6/1991 | Crum . | |
| 5,161,687 | 11/1992 | Kornell et al. | 206/447 |
| 5,209,353 | 5/1993 | Lehtovaara . | |
| 5,332,265 | 7/1994 | Groess et al. . | |

FOREIGN PATENT DOCUMENTS

| | | | |
|---|---|---|---|
| 57939 | 1/1912 | Switzerland | 206/450 |
| 8525 | of 1913 | United Kingdom | 206/451 |

*Primary Examiner*—Bryon P. Gehman
*Attorney, Agent, or Firm*—Theodore R. Touw

[57] ABSTRACT

In a self-contained information-bearing package for labels, a number of conventional self-adhesive labels are made on a backing sheet, which may have two labels on each segment, on opposite sides. The backing sheet is made either in a folded length with several segments, or a plurality of backing sheet segments in a V-fold, for example. If the backing sheet is a folded length with several segments, it may be accordion-folded. If the backing sheet is a plurality of segments in a V-fold, a number of these are assembled as leaves in an assembly resembling a "perfect bound" book. These are inserted and attached at the fold line of a cover, which is folded to a closed position for distribution. Other pages, carrying printed indicia, may be included within the cover. These other pages may be mounted at a different fold line from the label-carrier leaves. The top cover can fit into a flap at the bottom, or can have a tab that fits into a slot. The cover may be integral with the backing sheet, carrying the labels itself. The cover preferably carries printed or embossed indicia with a promotional or informational message, a company logo, etc. A preferred embodiment has a decal which carries promotional indicia on the outside of the cover. When the decal is removed, the same promotional indicia or some other message is revealed under the decal, and remains on the cover while the decal is removed to be applied to another convenient surface chosen by the user.

3 Claims, 3 Drawing Sheets

PROMOTIONAL PACKAGING ASSEMBLY FOR LABELS

The invention of this application was described in Disclosure Document, Ser. No. 373,155, received in the United States Patent and Trademark Office on Mar. 24, 1995.

FIELD OF THE INVENTION

This invention relates generally to packages for labels, and particularly to packaging assemblies which carry removable, reusable promotional or informational messages and which also contain self-adhesive labels.

BACKGROUND OF THE INVENTION

The reusable storage media in common use, such as computer magnetic diskettes, video tapes, and audio tapes, create a continuing need for labels specifically designed for each medium. While many of these storage media are sold with labels, continued reuse of the storage media frequently causes a need for additional labels, beyond the quantities provided with the media. Packages of additional labels are often not available when needed, and some labels are packaged in inconvenient packages. Many media labels are packaged in cardboard, plastic, or both. From the perspectives of natural resource conservation and protection of the environment, many media labels are excessively packaged.

When the users of these storage media attend trade shows or visit stores related to their use of the media, their attention may be sought by distributing easy-to-use packages of labels, in which the packaging carries messages, such as promotional messages or advertising, computer software installation instructions or user help information, storage media specifications, or other information helpful to the label user or to the suppliers of related products. When that message or that information is made removable from the package and is itself reusable elsewhere, the utility of the package and of the information may be significantly improved. The need for improved label packaging is expected to increase as new reusable media such as digital audio and video tapes and recordable compact disks and video disks find more common public use.

NOTATIONS AND NOMENCLATURE

The term decal is used in this specification and in the appended claims to mean a thin flat article pre-printed and specially adapted for transferring from a carrier surface to another surface. The term "accordion fold" denotes a folding of a sheet-like article having panels, plies, or segments defined between fold lines, such that segments fold in opposite directions at alternate fold lines and successive segments stack on each other when fully folded. This type of fold has also been called a "zigzag fold," as an edge view of a partially unfolded accordion-folded article resembles a zigzag line. The term "letter fold" denotes herein a folding method for a sheet-like article having segments defined between fold lines, such that successive segments fold in the same direction. For more than two folds, this type of folding is denoted by the term "roll fold." If the letter- or roll- folded article is to be substantially flat, the segments must vary in size (distance between fold lines), with at least some inner segments being smaller than outer segments. The term "gate fold" denotes the type of folding exemplified by an elongated sheet folded first from its two ends toward the center, then folded in the center so that each end segment lies on an adjacent inner segment when the article is fully folded. The terms panel, segment, and ply or plural plies are used interchangeably herein to refer to similar flat sheet-like elements.

DESCRIPTION OF THE RELATED ART

Many types of labels and many types of promotional packaging have been developed over the years for general use or for specific purposes. Typical examples of various types of labels and articles or packaging containing labels are those of U.S. Pat. Nos. 619,054; 4,204,706; 4,627,994; 4,872,706; 4,890,862; 4,973,088; 5,022,526; 5,209,353; and 5,332,265. U.S. Pat. No. 619,054 to Strauss et al. disclosed a label-holding book having a bound series of sheets of gummed labels and a combined clamp and stripper plate. U.S. Pat. No. 4,204,706 to Blum et al. disclosed a multilayer labeling system including a label having an adhesive coated back surface adhesively mounted on a backing sheet, and a transparent removable separator sheet including a spot carbonized portion. U.S. Pat. No. 4,627,994 to Welsch disclosed a label-beating continuous business form including an elongated ply of label stock having one side coated with a pressure-sensitive adhesive, an elongated ply of release liner stock of the same width engaged with the adhesive in such a way that the plies are laterally offset, leaving a narrow longitudinal strip of adhesive unengaged, and an elongated ply of record or message bearing stock adhered at the narrow longitudinal strip of adhesive. U.S. Pat. No. 4,872,706 to Brewen et al. disclosed a postage ad label assembly including a label having a print side onto which an advertisement can be printed and a postage stamp affixed. U.S. Pat. No. 4,890,862 to Buchholz disclosed a business form with a removable adhesive-free data card. U.S. Pat. No. 4,973,088 to Levy disclosed a changeable labelling system for recording media structures, with a plurality of stacked paper labels, each except the bottom label secured to an identical underlying label by a low adhesion substance. U.S. Pat. No. 5,022,526 to Crum disclosed a piggyback expandable package assembly for attachment to bottles, containers, and closure caps as well as to other surfaces. The piggyback package assembly has a base, the underside of which has adhesive so that the package assembly can be mounted on the top surface of a closure cap of a bottle, a web, or some other surface. U.S. Pat. No. 5,209,353 to Lehtovaara disclosed a filing system for computer diskettes with an identification label and a filing enclosure shaped to permit viewing of the label when the diskette is contained in the enclosure. U.S. Pat. No. 5,332,265 to Groess et al. disclosed an advertising assembly including a paper or polymeric backing layer having opposite major surfaces printed with advertising indicia and a plurality of sheets each comprising a layer of flexible polymeric material having a coating of repositionable pressure-sensitive adhesive on a portion and being free of adhesive on another portion. The sheets are releasably adhered in parallel rows to the backing layer, with the sheets in each row positioned with their side edge surfaces adjacent. The individual sheets may be removed by potential customers. These various prior labels or assemblies and others have met with varying degrees of success in the specific uses for which they have been employed.

OBJECTS AND ADVANTAGES OF THE INVENTION

One object of the invention is providing a convenient pocket-size package for labels. A related object is a self-contained package specially adapted for holding, protecting, and dispensing small quantities of labels. Another related object is a package for labels intended to be used on reusable storage media of uniform size and shape such as computer diskettes, and audio and video tapes. Another object is a package for labels that uses only a small amount of material which is substantially recyclable, and that contributes minimally to excessive waste and environmental pollution. Related objects are label packages that have reduced shipping weight and require less space on retail shelves or display racks. An important object is a promotional article that is easily and inexpensively manufactured. Another object is providing a promotional article to be distributed at trade shows and/or retail outlets while having various utilities related to the products displayed in such situations. Such utilities may include providing information helpful in installation and/or use of the related products or of the labels themselves and may include advertising information or symbols and/or features intended to encourage brand loyalty. A related object is a useful promotional article to be distributed as a whole, without requiring the removal of individual or singly-dispensed advertising sheets or tape flags for separate distribution. Another object is a promotional article carrying information or advertising that can be transferred to another surface by the user, as for example to remind oneself of the information while using or after using the promotional article or the product that it advertises. A closely related object is a promotional article that continues to display the same message, a related message, or a different message after a particular informational or promotional message is removed by the user. A particular object is a promotional package assembly for holding, protecting, and dispensing labels while displaying information by means of a removable and reusable decal which, before removal, may cover other information and which, after removal, may be applied to another surface.

SUMMARY OF THE INVENTION

The invention is designed to find some of its uses as a give-away promotional item, particularly at trade shows, in computer or software stores, in direct-mail advertising, etc. A number of conventional self-adhesive diskette labels are made on a backing sheet, which may have two labels on each segment, on opposite sides. The backing sheet is made either in a folded length with several segments, or a plurality of backing sheet segments in a V-fold, for example. If the backing sheet is a folded length with several segments, it may be accordion-folded. If the backing sheet is a plurality of segments in a V-fold, a number of these are assembled as leaves in an assembly resembling a "perfect bound" book. These are inserted and attached at the fold line of a cover, which is folded to a closed position for distribution. Other pages may be included within the cover, carrying printed indicia. These other pages may be mounted at a different fold line from the label-carrier leaves. The top cover can fit into a flap at the bottom, like a matchbook, or can fit into slots made in a bottom flap in various ways. The cover may be integral with the backing sheet, carrying the labels itself. The cover preferably carries printed or embossed indicia with a promotional or informational message, a company logo, etc. A preferred embodiment has a decal on the outside of the cover, which carries promotional indicia. When the decal is removed, the same promotional indicia or some other message is revealed under the decal, and remains on the cover while the decal is removed to be applied to another surface chosen by the user.

DETAILED DESCRIPTION OF THE PREFERRED EMBODIMENTS

Figure 1:
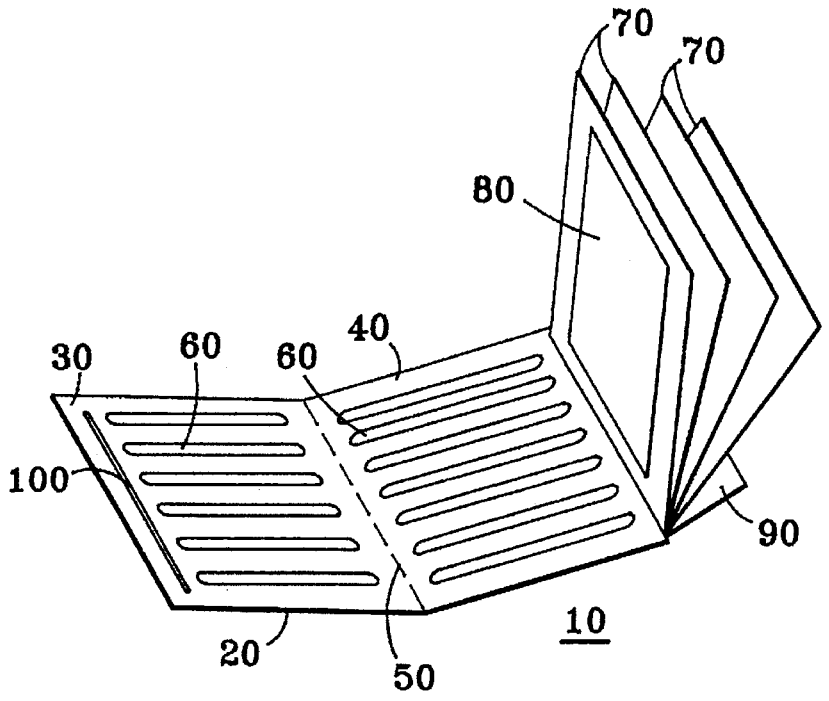
FIG. 1 shows a perspective view of a first embodiment of a label packaging assembly made in accordance with the invention, in its open position.

A number of embodiments of the invention are described in detail in the following paragraphs, with reference to the drawings, in which the same or similar elements in various figures are denoted by the same reference numerals.

FIG. 1 shows a perspective view of a first embodiment of a label packaging assembly made in accordance with the invention. The overall assembly, denoted generally by reference numeral 10, is shown in its open position. This embodiment has a cover 20 of card stock with two or more segments, such as segments 30 and 40 shown in FIG. 1. The segments meet each other at fold lines 50. Each of segments 30 and 40 has an inner surface (visible in FIG. 1), which may carry a printed message 60, and an outer surface (not visible in FIG. 1), which may carry a decal to be described herein below. Attached to cover 20 are one or more plies 70 of label-carrier stock, each of which carries at least one self-adhesive label 80. For clarity, FIG. 1 shows one label 80, but each of the plies 70 preferably carries at least one label. While label 80 is shown as rectangular in FIG. 1, the labels may have other shapes, e.g. round labels for recordable compact disks (CDs) or video disks.

Plies 70 are preferably slightly narrower in width than cover 20 (along the direction of fold lines 50). Plies 70 may be perforated (at fold lines 50 for example) for separation of individual plies by the user if desired. The stock material of label-carrier plies 70 comprises conventional release material commonly used to hold and to allow removal of self-adhesive labels, such as the stock available from KoBel International (USA) of Milton, Vt. as their item number 004. Preferably, carrier plies 70 have labels 80 on both sides of each ply. In FIG. 1, carrier plies 70 are attached at a fold line 50. They may be attached by any suitable fastener or other means, such as stitching, stapling, or adhesive attachment, for example. The embodiment illustrated in FIG. 1 also has a simple closure provided by a tab 90, which is inserted into a slot 100 when cover 20 is folded over itself at fold lines 50 to close the package assembly. Various other types of closures are shown in other drawings and described herein below. The package assembly may be left open at the edges that are perpendicular to fold lines 50, thus saving material.

Figure 2:
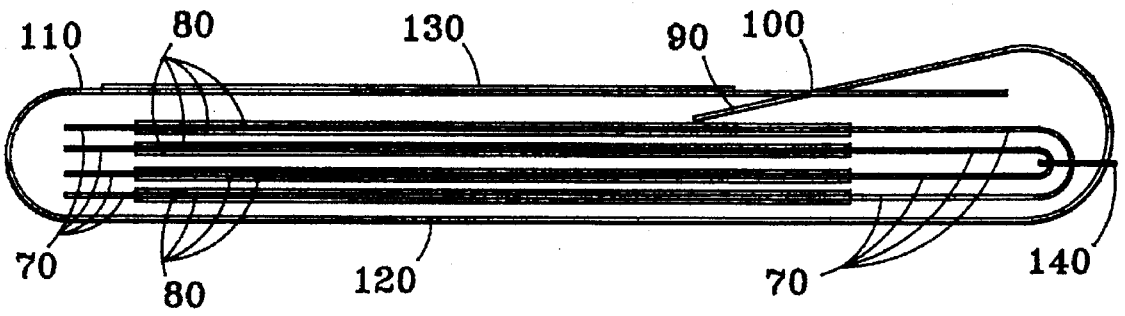
FIG. 2 shows a side elevation view of the packaging assembly of FIG. 1 in its closed position.

FIG. 2 shows schematically a side elevation view of the packaging assembly of FIG. 1 in its closed position. FIG. 2 is not drawn to scale; the vertical scale is exaggerated in order to more clearly show the relationships of the various elements of the assembly. These elements correspond to the elements having the same reference numerals in FIG. 1. The outer surfaces 110 and 120 of cover 20 that were not visible in FIG. 1 are the top and bottom surfaces seen edge-on in FIG. 2. Also seen edge-on in FIG. 2 are a decal 130, and fastening means 140 (such as a staple).

Figure 3:
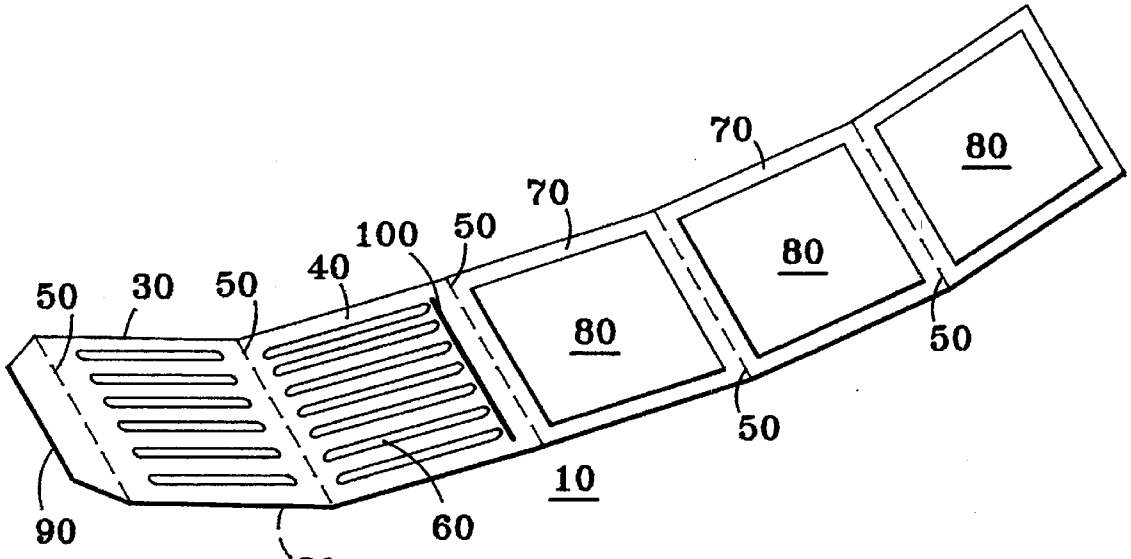
FIG. 3 shows a perspective view of a second embodiment of a label packaging assembly made in accordance with the invention, in its open position.
Figure 4:
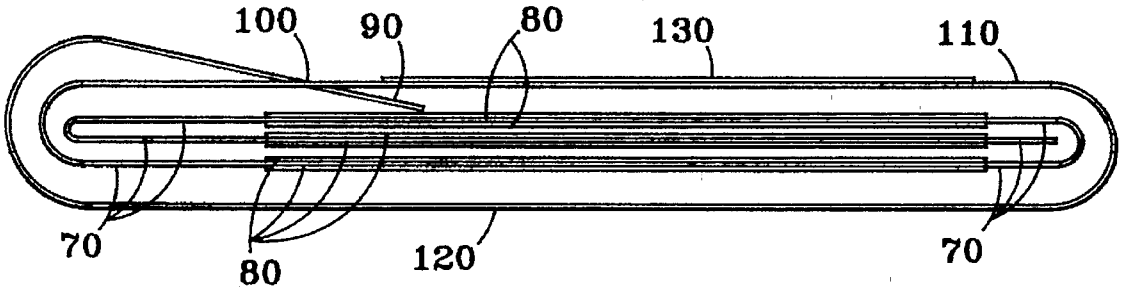
FIG. 4 shows a side elevation view of the packaging assembly of FIG. 3 in its closed position.

FIG. 3 shows a perspective view of a second embodiment of a label packaging assembly 10 in its open position. In this embodiment cover 20 and label carder sheet 70 are integrated in one continuous elongate sheet of card stock. At least some portions or segments of this sheet are prepared in a conventional manner to allow release of self-adhesive labels removably affixed to them, preferably on both sides of each segment. The segments are defined as those portions lying between fold lines 50. This assembly is roll-folded with the label-carrying end on the inside of the roll fold, so that tab 90 can engage slot 100. Various other types of closures are shown in other drawings and described herein below. FIG. 4 shows a side elevation view of the packaging assembly of FIG. 3, in its closed position. No fastener 140 is needed in this embodiment. While this embodiment is shown with a full roll fold, that particular fold arrangement is not essential. For example, the label-bearing segments 70 may be folded in an accordion fold, and then closing of the overall package assembly may be completed with a roll fold of cover segments 30 and 40 and tab 90.

Figure 5:
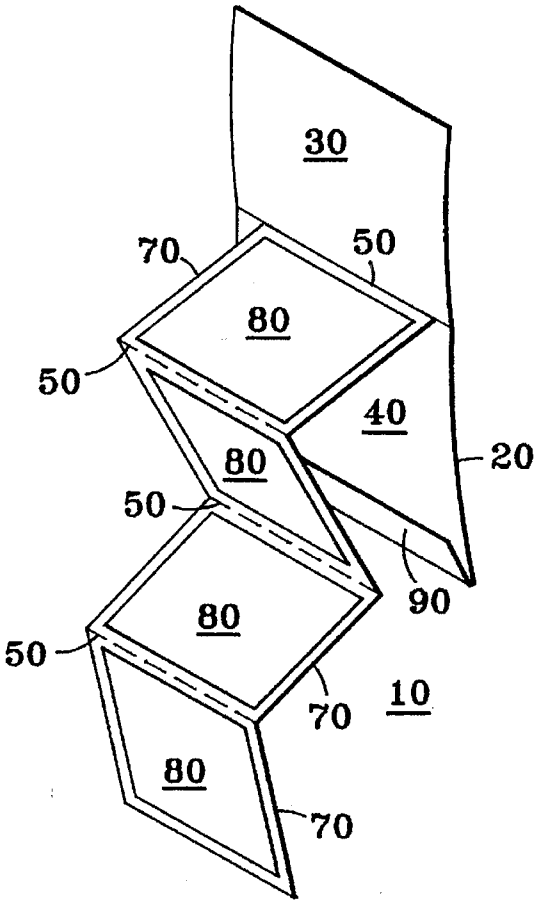
FIG. 5 shows a perspective view of a third embodiment of a label packaging assembly in its open position.

FIG. 5 shows a perspective view of a third embodiment of a label packaging assembly 10 in its open position. In this embodiment label-beating segments 70 are accordion-folded from an elongated sheet of release stock carrying labels 80 (which may be on both sides of each ply). The sheet of segments 70 is fastened at a fold line 50 of cover 20. Cover segment 30 may simply tuck behind tab 90 to form a closure when cover 20 is letter-folded over the label-bearing plies 70 to close the assembly, like a paper matchbook. The outer surfaces of cover segments 30 and 40 may carry a decal 130 (not visible in FIG. 5).

Figure 6:
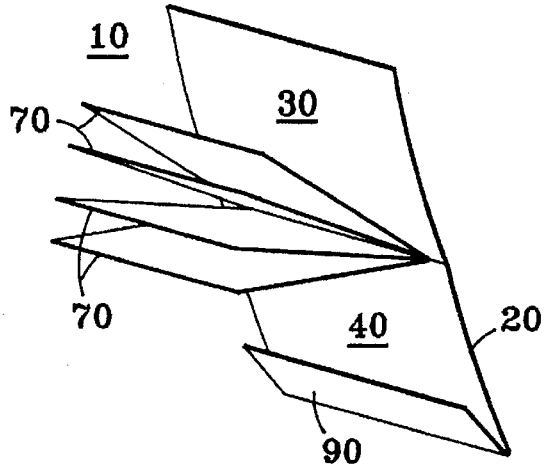
FIG. 6 shows a perspective view of a fourth embodiment of a label packaging assembly in its open position.

FIG. 6 shows a perspective view of a fourth embodiment of a label packaging assembly 10 in its open position. This embodiment has a book-like set of label-carrying plies 70 similar to those of FIG. 1, fastened at a fold line 50 of cover 20. Cover 20 closes using tab 90 in the same manner as in FIG. 5. Again, the outer surfaces of cover segments 30 and 40 may carry a decal 130 (not visible in FIG. 6).

Figure 7A:
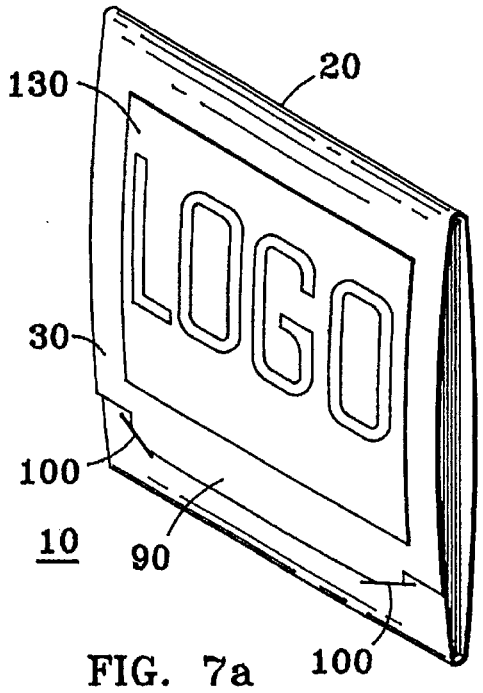
FIGS. 7*a* and 7*b* show perspective views of label packaging assemblies in their closed positions, illustrating various closure configurations made in accordance with the invention.
Figure 7B:
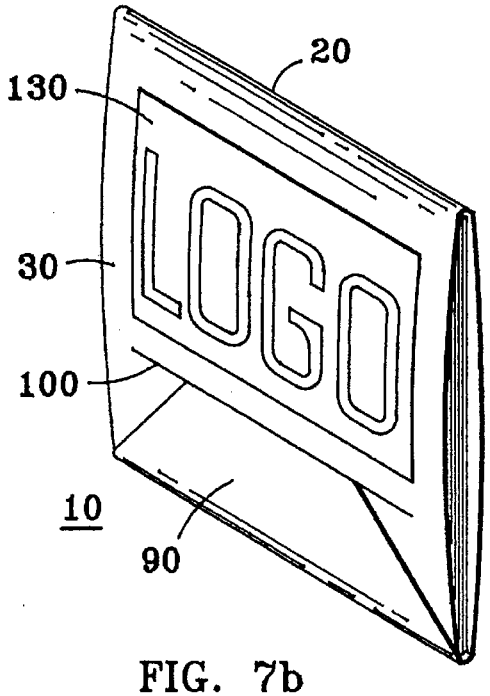

FIGS. 7*a* and 7*b* show perspective views of label packaging assemblies in their closed positions, illustrating various closure configurations made in accordance with the invention, and illustrating decal 130. The embodiment shown in FIG. 7*a* has a tab 90 depending from one of the cover segments 30, and formed by cutting a notch from each of two corners of that segment. Another cover segment 40 has two diagonally oriented slits disposed to receive tab 90 when cover 20 is closed. Any other closure means may of course be used including conventional means such as gummed tabs, staples, button and string, elastic cord, rubber bands, etc.

Figure 8:
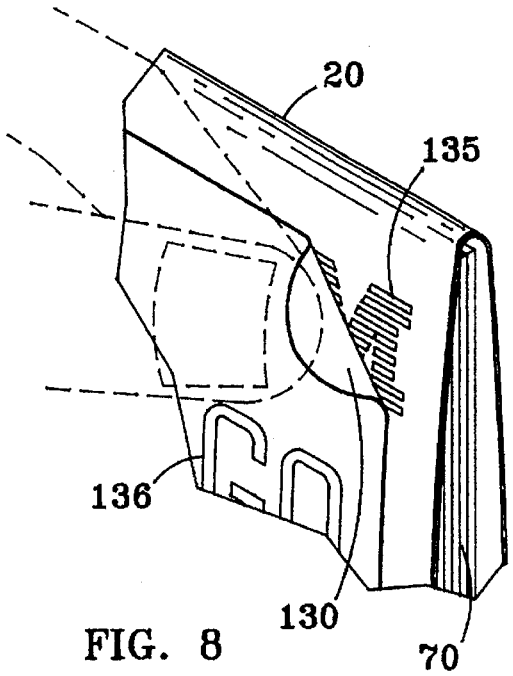
FIG. 8 shows a portion of the label packaging assembly in a perspective view.

Decal 130 is provided with the assembly by being removably adhered to one or both of the outside surfaces of cover 20. Decal 130 carries pre-printed indicia, such as a logo (indicated by the word "Logo" in FIGS. 7*a* and 7*b*), other advertising copy, or an informative message related to the products to be promoted or advertised. For example, if the product to be promoted is computer hardware or software, the decal may display installation instructions or a technical support telephone number. FIG. 8 shows a portion of the label packaging assembly, illustrating removal of decal 130 by a user to reveal indicia 135 underneath decal 130, and covered by the decal until the decal (carrying indicia 136) is removed.

When a user of the assembly removes decal 130 from the package, he may place it on another convenient surface to display the decal for reference. Furthermore, the portion of cover 20 covered by the decal when provided may also carry additional information that is revealed when the user removes the decal. The additional information may be the same as carried by the decal, or different information. If the decal is entirely opaque, the information under it is not revealed until the decal is removed, but it may be desirable in some applications to use a decal that is partially or wholly transparent or translucent so that the presence of additional information beneath the decal can be observed by a user. The information on a decal and underneath it may also be supplemented by information provided by printing indicia on the inside surfaces of cover 20, as illustrated in FIGS. 1 and 3. Thus a preferred embodiment of the promotional packaging assembly having one or more decals has additional uses besides containing, protecting, and dispensing quantities of labels. It is expected that recipients of such promotional packages will find them very useful, and thus hopefully will become favorably disposed toward the products promoted.

It should be noted that, for some application situations, it may be desirable to position decal 130 to cover an edge of the closure of cover 20, so that the decal must be removed to open the package. For some embodiments, a decal 130 may serve as the only closure means. These arrangements are not shown in the drawings.

In a typical manufacture of the packages, the indicia are imprinted on the cover and on the decal separately, the label-carrying stock is cut, folded and attached to the cover material (if it is not integral with the cover), the cover is folded and closed, and the decal added. This conventional sequence of manufacturing steps may be varied considerably as is known in the art, and many or all of the operations may be carded out virtually simultaneously by automatic machinery.

Thus in one aspect of the information-bearing package for labels described herein above, it is a combination of an elongated ply of card stock folded at a plurality of fold lines to form a package with two outer surfaces, a plurality of labels removably attached to the ply of card stock (each of the labels being attached between fold lines except at the two outer surfaces), preferably at least one decal carrying indicia and being removably attached to at least one of the outer surfaces, and closure means for the package. The decal, if provided, is re-attachable by a user to another convenient surface to display the information. When a user uses the package, he opens the cover to remove individual labels as needed, and may also remove the decal and attach it to a convenient flat surface for further reference, or to display the logo of the advertiser. If the decal covers other information, the user may retain the package for reference as long as the information is useful.

In another aspect of the information-carrying assembly for labels described herein above, it is a combination of a folded cover of card stock, having two outer surfaces which meet in at least one fold line and having means for closure, with an elongated ply of carder stock, folded at a plurality of carder fold lines, and attached inside the cover, and with a plurality of labels attached to the elongated ply of carrier stock between the carrier fold lines, and preferably with at least one decal carrying indicia and being removably attached to at least one the cover's outer surfaces. Here again, the decal is re-attachable by a user to another convenient surface to display the indicia it carries.

In yet another aspect of the invention described herein above, it is a promotional book of labels that is a combination of a cover of card stock folded at a number of fold lines to form a package with two outer surfaces (the cover having an area on at least one of the two outer surfaces adapted to receive indicia), with a decal attached removably to at least one of the two outer surfaces, and also with a number of leaves or pages attached at one of the fold lines, each of the leaves removably carrying at least one self-adhesive label, and with means for holding the cover closed surrounding the leaves or pages. The book may also have a second set of leaves or pages adapted to carry additional printed indicia.

Although specific embodiments of the present invention have been illustrated in the accompanying drawings and described in the foregoing detailed description, it will be understood that the invention is not limited to the particular embodiments described herein, but is capable of numerous substitutions, modifications, and rearrangements to adapt it to various usages and conditions without departing from the scope of the invention. For example, features of the embodiment of FIGS. 1 and 2 may be combined with features of the embodiment of FIGS. 3 and 4 to produce an assembly having one set of book-like pages carrying printed indicia, a second set of pages carrying self-adhesive labels, and a cover folding (for example) in a gate fold, carrying additional printed indicia and a decal on an outer surface of the cover. Other embodiments of the invention will be apparent to those skilled in the art from a consideration of this specification or from practice of the invention disclosed herein. It is intended that the specification and examples be considered as exemplary only, with the true scope and spirit of the invention being defined by the following claims.

Having described my invention, I claim:

1. A promotional book of labels, comprising in combination:

(a) a cover having at least two major outer surfaces, said cover being formed by folding card stock at a plurality of fold lines, said cover having an area on at least one of said at least two major outer surfaces for receiving first indicia, said cover having first indicia disposed on said area;

(b) a first plurality of leaves attached proximate to one of said plurality of fold lines, each of said first plurality of leaves having at least one self-adhesive label removably attached thereto;

(c) means for holding said cover closed while surrounding said first plurality of leaves; and (d) a decal removably attached by adhesive to said area to overlay at least a portion of said first indicia, said decal adhesive being reusable for attachment to any suitable surface after being removed from said area.

2. A promotional book of labels as recited in claim 1 further comprising:

a second plurality of leaves for carrying second indicia, said second plurality of leaves having said second indicia disposed thereon, and said second plurality of leaves having no labels attached thereto.

3. A promotional book of labels as recited in claim 1, wherein said decal carries second indicia.

* * * * *